US008328037B2

(12) United States Patent
Wu

(10) Patent No.: US 8,328,037 B2
(45) Date of Patent: Dec. 11, 2012

(54) BOTTLE CAP ASSEMBLY

(76) Inventor: Tung Feng Wu, Changhua (TW)

( * ) Notice: Subject to any disclaimer, the term of this patent is extended or adjusted under 35 U.S.C. 154(b) by 0 days.

(21) Appl. No.: 13/190,528

(22) Filed: Jul. 26, 2011

(65) Prior Publication Data

US 2012/0018431 A1 Jan. 26, 2012

(30) Foreign Application Priority Data

Jul. 26, 2010 (TW) ..... 99214245 U

(51) Int. Cl.
*A47G 19/22* (2006.01)
*B65D 43/14* (2006.01)

(52) U.S. Cl. ..... 220/259.4; 220/254.8; 220/259.1; 220/714; 220/717

(58) Field of Classification Search ..... 220/259.4, 220/707, 708, 714, 717, 254.8, 259.1; 222/464.1
See application file for complete search history.

(56) References Cited

U.S. PATENT DOCUMENTS 7,350,666 B2 * 4/2008 Essebaggers ..... 220/714
7,651,003 B2 * 1/2010 Albers et al. ..... 215/311
7,959,045 B2 * 6/2011 Kuge et al. ..... 222/495
7,988,004 B1 * 8/2011 Marret et al. ..... 215/252
8,042,701 B2 * 10/2011 Raman et al. ..... 215/229
2003/0057209 A1 * 3/2003 Seelhofer ..... 220/259.1
2004/0251276 A1 * 12/2004 Adams et al. ..... 222/153.14
2005/0040190 A1 * 2/2005 Stoneberg et al. ..... 222/521
2006/0163189 A1 * 7/2006 Laveault et al. ..... 215/252
2007/0205229 A1 * 9/2007 Schmeisser et al. ..... 222/525
2008/0110511 A1 * 5/2008 Kuna et al. ..... 137/616.5
2008/0223485 A1 * 9/2008 Nyambi et al. ..... 141/351

* cited by examiner

*Primary Examiner* — Mickey Yu
*Assistant Examiner* — Niki Eloshway
(74) *Attorney, Agent, or Firm* — Bacon & Thomas, PLLC

(57) ABSTRACT

A bottle cap assembly includes a mount, a hose unit connected to the mount, a mouthpiece unit and a dust cap. A lug is connected to the mount and the dust cap is pivotably connected to the lug. A tubular portion is located in the mount and has two spiral ribs. The mouthpiece unit includes a rotatable member, a seal ring and a mouthpiece. The rotatable member is engaged within the tubular portion and has spiral grooves with which the spiral ribs are engaged. The rotatable member has a knob and has a passage is defined therethrough. The seal member seals the mouthpiece unit when the rotatable member is located at the lowest position. When the knob is rotated, the spiral grooves moved upward along with the spiral rib and the passage is separated from the seal member to open the mouthpiece unit.

4 Claims, 5 Drawing Sheets

BOTTLE CAP ASSEMBLY

FIELD OF THE INVENTION

The present invention relates to a bottle cap assembly, and more particularly, to a rotatable bottle cap connected with a hose.

BACKGROUND OF THE INVENTION

A conventional water bottle cap with a hose is disclosed in CN 201381022 and includes a cap and a hose, wherein the cap has a recessed area from which a tube is extended and the hose is mounted to the tube. A suction unit is pivotably connected to the recessed area and includes a pivot and a mouthpiece which is securely connected to the pivot. The mouthpiece has a passage which communicates with the tube. The pivot includes a protrusion which positions the suction unit when the suction unit is in closed position. The benefits of the cap is that the protrusion well positions the suction unit when not in use so that the liquid in the bottle cannot not flow out from the suction unit. However, the protrusion tends to be worn out after frequent uses and is loosened or even disengaged from the recess in the recessed area. This restricts the reliability and durability of the product. Besides, there is no dust cap provided and the users have to directly operate the suction unit and directly touch the suction part which may be contaminated.

The present invention intends to provide a bottle cap assembly to improve the shortcomings of the above mentioned conventional cap assembly.

SUMMARY OF THE INVENTION

The present invention relates to a bottle cap assembly and comprises a mount, a hose unit, a mouthpiece unit and a dust cap. The mount has an air hole and a lug, and two recesses are defined in the inside of the lug. An inlet valve 14 is engaged with the air hole and a tubular portion is located in the mount 1 and extends toward a bottle. The tubular portion has two spiral ribs and a seal member is located at a central portion of the tubular portion. The hose unit is connected between the tubular portion and a hose which is inserted into a bottle. The mouthpiece unit is connected to the mount and comprises a rotatable member, a seal ring and a mouthpiece. The rotatable member has spiral grooves defined in a lower portion thereof, and a knob and a first engaging groove are located on the top of the rotatable member. A passage is defined through the rotatable member and a sealing groove is defined in the outer surface of the mediate portion of the rotatable member. A seal ring is engaged with the seal groove. The rotatable member is engaged within the tubular portion and the spiral ribs are engaged with the spiral grooves. The seal member is located in the passage and seals the mouthpiece unit when the rotatable member is located at the lowest position. When the knob is rotated, the spiral grooves are moved upward along with the spiral ribs and the passage is separated from the seal member to open the mouthpiece unit, so that the user can suck the liquid in the bottle via the mouthpiece. The dust cap is mounted to the top of the mount and accommodating the mouthpiece unit. The dust cap has a locking point at the inside thereof so that when the dust cap is mounted to the mouthpiece, the locking point is engaged with the knob to secure the dust cap. An ejection valve is connected to the rotatable member which is secured by using a pressing ring.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
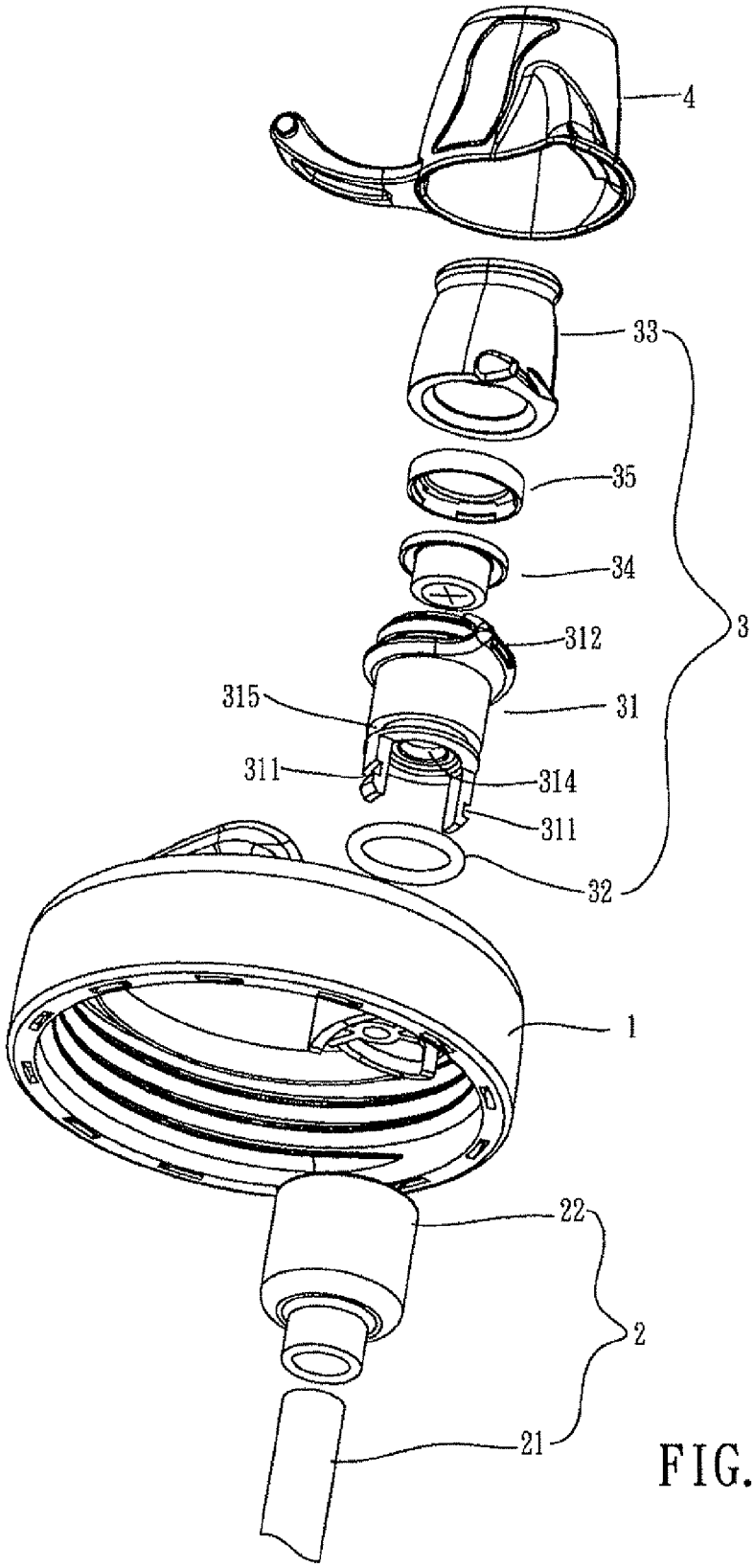
FIG. 1 is an exploded view to show the bottle cap assembly of the present invention.
Figure 2:
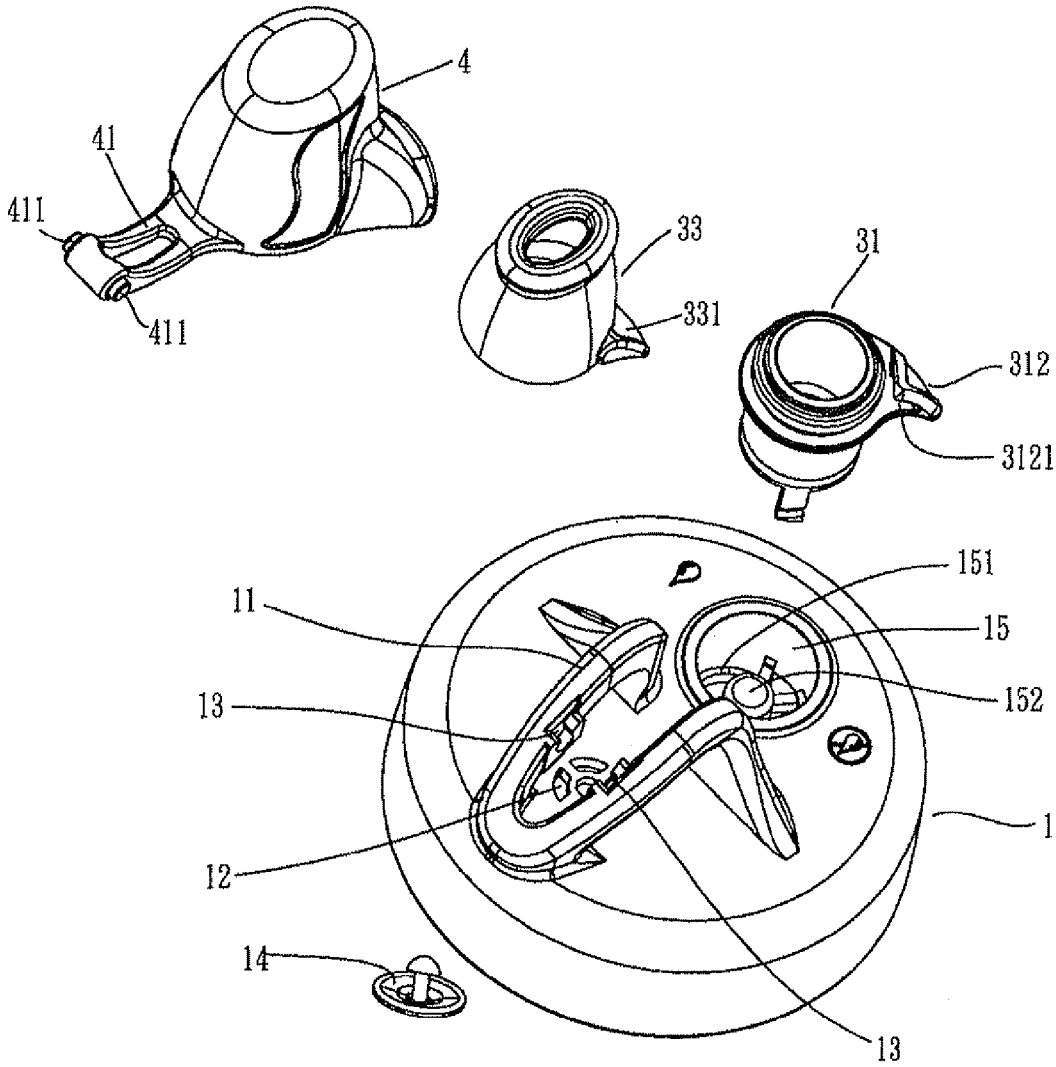
FIG. 2 is an exploded view to show the mount and the parts connected to the top of the mount of the bottle cap assembly of the present invention.

Referring to FIGS. 1 and 2, the bottle cap assembly of the present invention comprises a mount 1, a hose unit 2, a mouthpiece unit 3 and a dust cap 4. The hose unit 2 has a hose 21 and a connection member 22. The mouthpiece unit 3 is connected to a top of the mount 1 and includes a rotatable member 31, a seal ring 32 and a mouthpiece 33. The rotatable member 31 has spiral grooves 311 defined in the lower portion thereof and a knob 312 is located on the top of the rotatable member 31. A passage 314 is defined through a central portion of the rotatable member 31 and a sealing groove 315 is defined in the outer surface of the mediate portion of the rotatable member 31 so that a seal ring 32 is engaged with the sealing groove 315. The mouthpiece unit 3 can be cooperated with an ejection valve 34 and a pressing ring 35.

The mount 1 has an air hole 12 defined through the top thereof and an inlet valve 14 engaged with the air hole 12. The mount 1 further has a lug 11 on the top thereof and two recesses 13 are defined in the inside of the lug 11. A tubular portion 15 is located in the mount 1 and extends toward a bottle 5 to which the mount 1 is connected. The tubular portion 15 has two spiral ribs 151 on the bottom thereof and a seal member 152 is located at the central portion of the tubular portion 15. The knob 312 has a gap 3121 defined in the inside thereof. The mouthpiece 33 includes a protrusion 331. The dust cap 4 has a lever 41 which has two bosses 411 on two sides of a distal end thereof, the bosses 411 are engaged with the recesses 13 of the lug 11.

Figure 3:
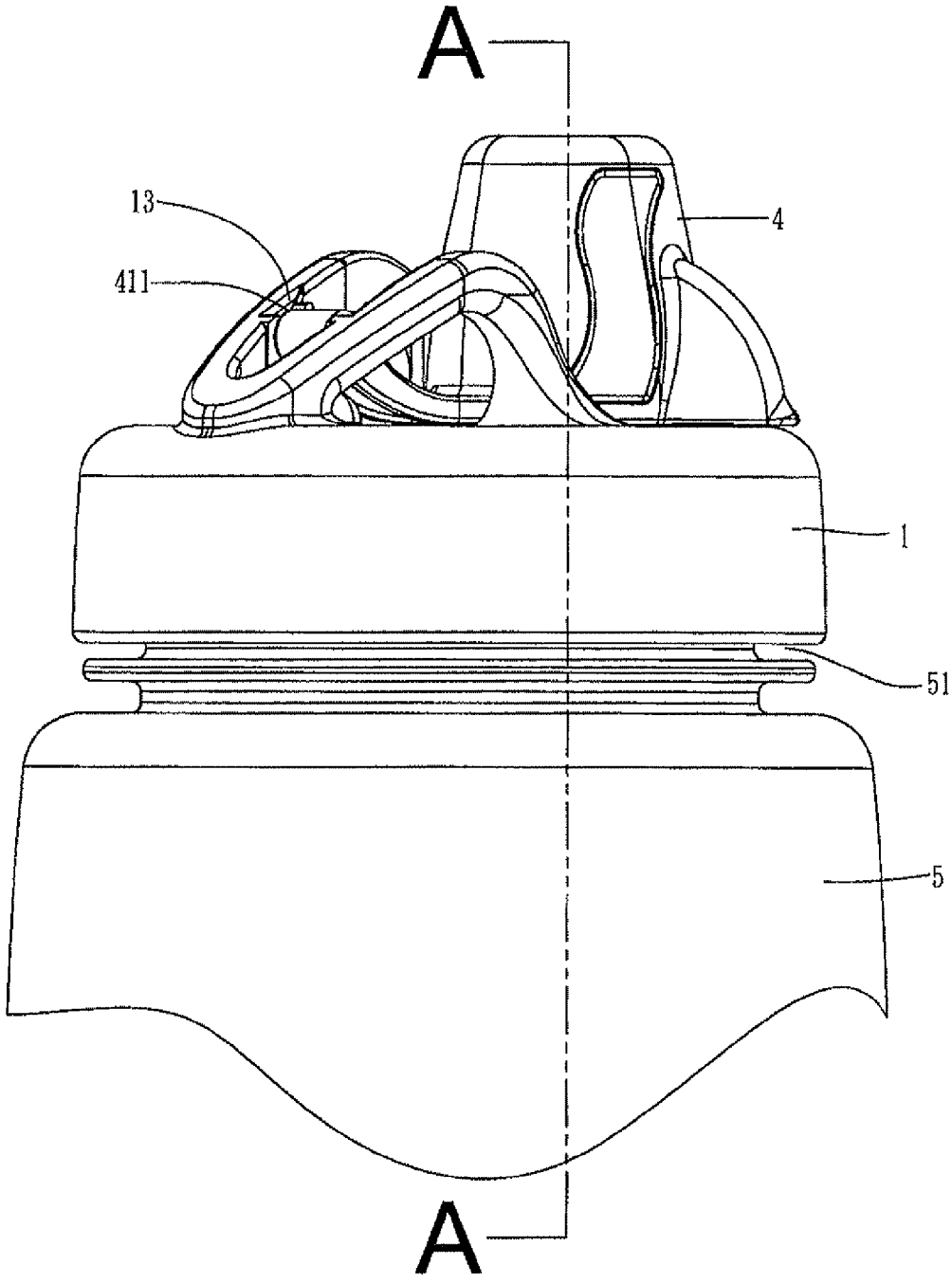
FIG. 3 is a side view to show the bottle cap assembly connected to a bottle.

As shown in FIG. 3, when assembling the bottle cap assembly, the mount 1 is threadedly connected to the open top 51 of the bottle 5 and the dust cap 4 is mounted to the top of the mount 1.

Figure 4:
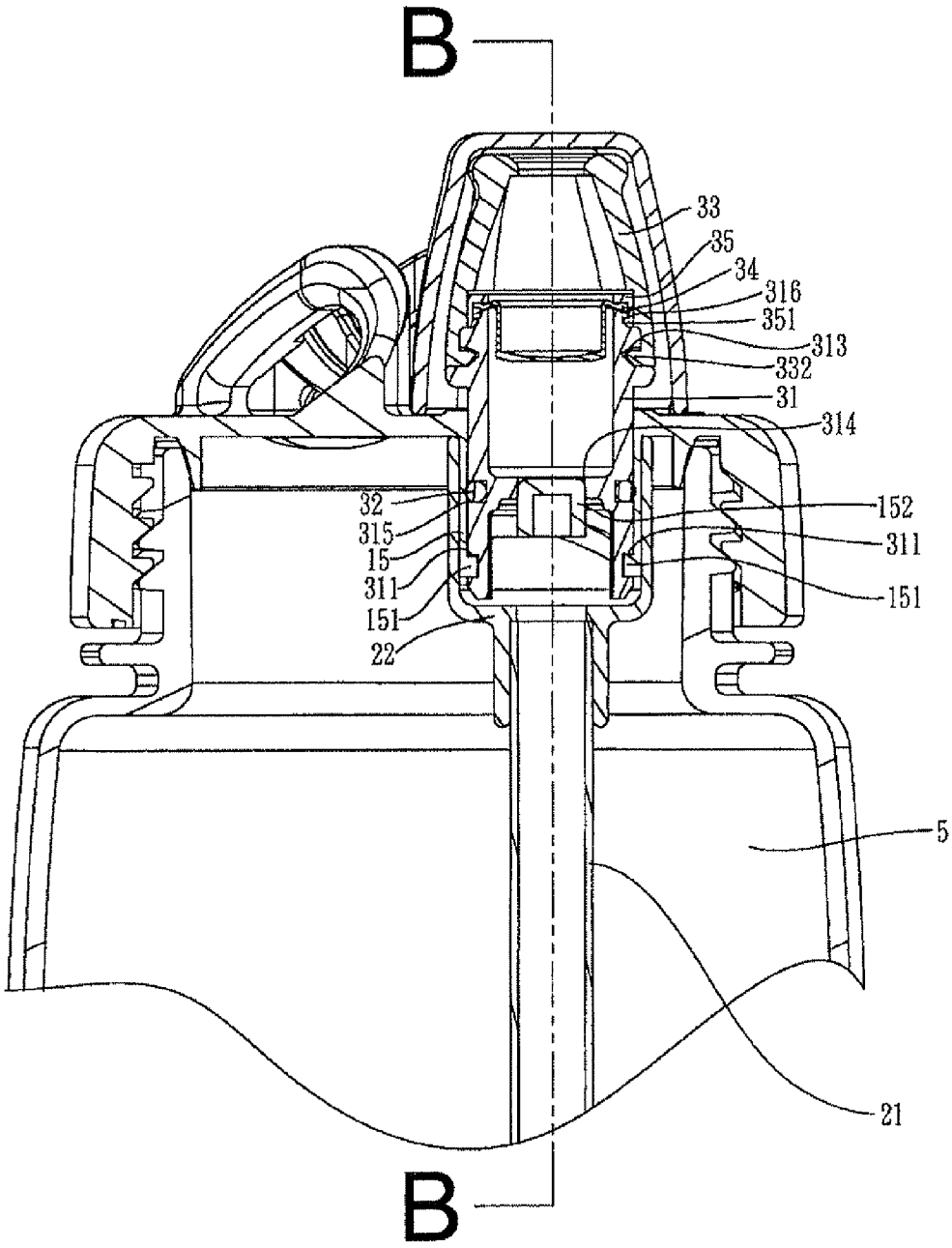
FIG. 4 is a cross sectional view, taken along line A-A in FIG. 3, wherein the mouthpiece unit is in closed position.

As shown in FIG. 4, the hose 21 is connected to the connection member 22 which is connected to the tubular portion 15, and the hose 21 extends into the bottle 5. The rotatable member 31 is connected with the tubular portion 15 through the spiral ribs 151 of tubular portion 15 being engaged with the spiral grooves 311 of rotatable member 31. The seal ring 32 is engaged with the seal groove 315 of the rotatable member 31 so that the gap between the outside of the rotatable member 31 and the inside of the tubular portion 15 is sealed. The rotatable member 31 includes a first engaging groove 313 and a second engaging groove 316 at a top thereof. The mouthpiece 33 has a lip 332 extending from the inside thereof and the lip 332 is engaged with the first engaging groove 313 so as to position the mouthpiece 33. The ejection valve 34 is connected to the top of the rotatable member 31 and a pressing ring 35 is connected to the top of the ejection valve 34. A ridge 351 extends from the inside of the pressing ring 35 and is engaged with the second engaging groove 316 to secure the pressing ring 35 and position the ejection valve 34. The seal member 152 is located adjacent the passage 314 and seals the mouthpiece unit 3 by closing off passage 314 when the rotatable member 31 is rotated and disposed at its lowest position, as shown in FIG. 4.

Figure 5:
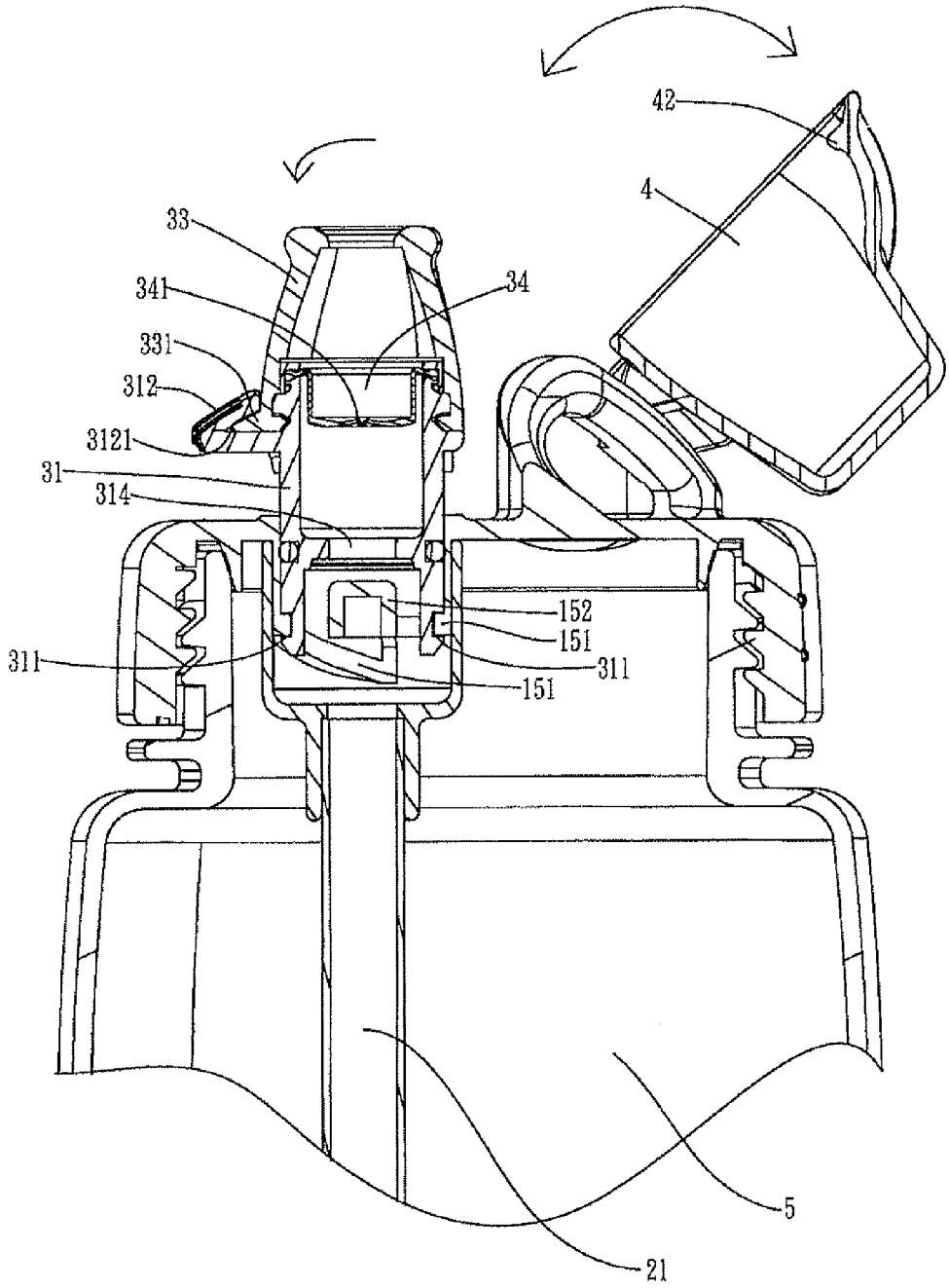
FIG. 5 is a cross sectional view, taken along line B-B in FIG. 4, wherein the mouthpiece unit is in opened position.

As shown in FIG. 5, the protrusion 331 is engaged with the gap 3121 defined in the inside of the knob 312 on the top of the rotatable member 31. The dust cap 4 has a locking point 42 at the inside thereof so that when the dust cap 4 is mounted to the mouthpiece 33, the locking point 42 is engaged with the knob 312 to secure the dust cap 4. By rotating the knob 312 about 90 degrees, the spiral grooves 311 are moved upward from their lowest position to the highest position of the spiral ribs 151. This causes the rotatable member 31 to be correspondingly moved upward to its highest position, thereby disengaging the seal member 152 from passage 314 and permitting liquid to flow from bottle 5 through passage 314 and hole 341 of ejection valve 34 and out mouthpiece 33 of the mouthpiece unit 3. If the bottle is made by hard material, the ejection valve 34 cannot be used and the liquid in the bottle 5 can be sucked by the hose 21. If the bottle is made by soft material, the ejection valve 34 can be used and, by squeezing the bottle 5, the liquid is ejected out from the through hole 341 and the mouthpiece 33 via the hose 21.

While we have shown and described the embodiment in accordance with the present invention, it should be clear to those skilled in the art that further embodiments may be made without departing from the scope of the present invention.

What is claimed is:

1. A bottle cap assembly comprising:

a mount having an air hole defined through a top thereof and an inlet valve engaged with the air hole, a tubular portion located in the mount and adapted to extend toward a bottle for containing liquid, the tubular portion having two spiral ribs on a bottom thereof and a seal member located at a central portion of the tubular portion;

a hose unit connected to the mount and adapted to insert into the bottle;

a mouthpiece unit connected to a top of the mount and including a rotatable member, a seal ring and a mouthpiece, the rotatable member having spiral grooves defined in a lower portion thereof, a knob and a first engaging groove located on a top of the rotatable member, a passage defined through a central portion of the rotatable member and a sealing groove defined in an outer surface of a mediate portion of the rotatable member, a seal ring engaged with the seal groove, the spiral grooves of rotatable member being engaged with the spiral ribs of the tubular portion for permitting rotation of the rotatable member relative to the tubular portion to dispose the rotatable member between a lowest position, at which the seal member engages the passage to prevent liquid flow from the bottle through the mouthpiece, and a highest position, at which the seal member disengages from the passage to permit liquid flow from the bottle through the mouthpiece, and a dust cap mounted to the top of the mount and accommodating the mouthpiece unit.

2. The bottle cap assembly as claimed in claim 1, wherein the mount has a lug on the top thereof and two recesses are defined in an inside of the lug, the dust cap has a lever which has two bosses on two sides of a distal end thereof, the bosses are engaged with the recesses of the lug, the rotatable member includes a first engaging groove at a top thereof, the mouthpiece has a lip extending from an inside thereof and the lip is engaged with the first engaging groove so as to position the mouthpiece, the mouthpiece includes a protrusion which is engaged with a gap defined in an inside of the knob, the dust cap has a locking point at an inside thereof so that when the dust cap is mounted to the mouthpiece, the locking point is engaged with the knob to secure the dust cap.

3. The bottle cap assembly as claimed in claim 1, wherein the hose unit has a hose and a connection member which is connected between the tubular portion and the hose.

4. The bottle cap assembly as claimed in claim 1, wherein the rotatable member has a second engaging groove defined in a top thereof and an ejection valve is connected to the top of the rotatable member, a pressing ring is connected to a top of the ejection valve and a ridge extends from an inside of the pressing ring, the ridge is engaged with the second engaging groove to secure the pressing ring and position the ejection valve.

* * * * *